US010194237B2

(12) United States Patent
Liu et al.

(10) Patent No.: US 10,194,237 B2
(45) **Date of Patent: *Jan. 29, 2019**

(54) ELECTRONIC DEVICE

(71) Applicant: Acer Incorporated, New Taipei (TW)

(72) Inventors: Feng-Ming Liu, New Taipei (TW); Jia-Ren Chang, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/820,703

(22) Filed: Nov. 22, 2017

(65) Prior Publication Data

US 2018/0098148 A1 Apr. 5, 2018

Related U.S. Application Data

(63) Continuation of application No. 15/141,793, filed on Apr. 28, 2016, now Pat. No. 9,860,632.

(30) Foreign Application Priority Data

Nov. 3, 2015 (TW) ..... 104136132

(51) Int. Cl.
*H04R 1/34* (2006.01)
*H04R 1/02* (2006.01)

(52) U.S. Cl.
CPC ..... *H04R 1/345* (2013.01); *H04R 1/02* (2013.01); *H04R 2499/11* (2013.01)

(58) Field of Classification Search
CPC ..... G06F 1/1632; G01G 19/52; H04R 1/02; H04R 1/345
USPC ..... 340/539.11; 379/428.01; 381/338, 152, 381/86, 352, 373, 380; 455/575.1, 575.4; 310/307; 522/94; 181/199
See application file for complete search history.

(56) References Cited

U.S. PATENT DOCUMENTS

| | | | | |
|---|---|---|---|---|
| 4,726,066 | A | 2/1988 | Bloomfield, III | |
| 4,763,111 | A | 8/1988 | Matsuo | |
| 5,402,486 | A | 3/1995 | Wang | |
| 6,332,029 | B1 * | 12/2001 | Azima | B42D 15/022 181/166 |
| 6,628,040 | B2 * | 9/2003 | Pelrine | F02G 1/043 310/307 |
| 7,199,166 | B2 * | 4/2007 | Gloeckner | C08F 283/00 522/109 |
| 8,042,647 | B1 | 10/2011 | Layton, Jr. | |
| 8,213,668 | B2 | 7/2012 | Tsao | |
| 9,241,221 | B2 | 1/2016 | Wei | |

(Continued)

*Primary Examiner* — Gerald Gauthier
(74) *Attorney, Agent, or Firm* — McClure, Qualey & Rodack, LLP

(57) ABSTRACT

An electronic device is provided which includes a sliding groove, a speaker and a sound conditioner. The first sound outlet and the second sound outlet are connected to the sliding groove and respectively positioned adjacent to the first side wall and the second side wall of the sliding groove. The speaker is positioned relative to the first sound outlet. The sound conditioner extends along the sliding groove for a length that is greater than the distance between the first sound outlet and the second sound outlet. The sound conditioner is slidably positioned in the sliding groove so as to allow the sound produced by the speaker to be transmitted to the outside via either the first sound outlet or the second sound outlet.

13 Claims, 7 Drawing Sheets

(56) References Cited

U.S. PATENT DOCUMENTS 9,380,364 B2 * 6/2016 Chen ..... H04R 1/025
9,560,462 B2 1/2017 Eriksen
9,860,632 B2 * 1/2018 Liu ..... H04R 1/02
2003/0215087 A1 * 11/2003 Tsai ..... H04M 1/6075 379/428.01
2004/0145859 A1 7/2004 Nakamichi
2005/0049016 A1 * 3/2005 Cho ..... H04M 1/0202 455/575.1
2007/0280497 A1 12/2007 Isberg
2008/0044044 A1 2/2008 Madaffari
2008/0139258 A1 * 6/2008 Park ..... H01R 13/447 455/575.1
2009/0104950 A1 * 4/2009 Huang ..... G06F 1/1616 455/575.4
2010/0061582 A1 * 3/2010 Takigawa ..... H04R 1/1041 381/380
2010/0166245 A1 * 7/2010 Takigawa ..... H04R 1/1041 381/380
2011/0000740 A1 1/2011 Carter
2011/0215921 A1 * 9/2011 Ben Ayed ..... G08B 1/08 340/539.11
2012/0281866 A1 11/2012 Yoo
2013/0265150 A1 10/2013 Nakayama
2015/0053497 A1 * 2/2015 Horiuchi ..... H04N 5/642 181/199
2015/0055814 A1 * 2/2015 Liu ..... H04R 1/1075 381/373
2015/0098601 A1 * 4/2015 Absher ..... H04R 1/345 381/352
2016/0052449 A1 * 2/2016 Okuyama ..... B60R 19/48 381/86
2016/0238433 A1 * 8/2016 Kuo ..... G01G 19/52
2016/0309272 A1 10/2016 Wang
2016/0327983 A1 * 11/2016 Wang ..... G06F 1/1632
2017/0127176 A1 * 5/2017 Liu ..... H04R 1/345
2018/0098148 A1 * 4/2018 Liu ..... H04R 1/02

* cited by examiner

ELECTRONIC DEVICE

CROSS REFERENCE TO RELATED APPLICATIONS

This application is a continuation of application Ser. No. 15/141,793, filed on Apr. 28, 2016, now U.S. Pat. No. 9,860,632, which claims the priority of Taiwan Patent Application No. 104136132, filed on Nov. 3, 2015, the entirety of which is incorporated by reference herein.

BACKGROUND OF THE INVENTION

Field of the Invention

The present invention relates to an electronic device and elements thereof, and more particularly to an electronic device being able to change position where sound is transmitted and elements thereof to facilitate the change.

Description of the Related Art

Generally, an electronic device (such as mobile cell phone, tablet, or notebook) includes one speaker. The electronic device's speaker receives signals from a control unit and converts these signals into corresponding acoustic waves that can be heard by a human being. To make sure that the user can hear the sound converted by the speaker, the speaker is arranged on the lower side of the electronic device to be near the user.

However, since there is only one sound outlet formed on a conventional electronic device, sound produced by the speaker is broadcast at one single side of the electronic device, which may result in an unpleasant listening experience for the user.

BRIEF SUMMARY OF THE INVENTION

Accordingly, one objective of the present invention is to provide an electronic device, which has at least two sound outlets, sound is selectively transmitted to the outside via one of the two sound outlets, so as to provide a high-quality listening experience.

In accordance with one embodiment of the disclosure, an electronic device is provided. The electronic device includes a sliding groove, a speaker and a sound conditioner. The sliding groove extending from the first side wall to the second side wall along a predetermined direction. A first sound outlet and a second sound outlet are connected to the sliding groove and respectively positioned adjacent to the first side wall and the second side wall. The speaker is positioned relative to the first sound outlet. The sound conditioner extends along the sliding groove for a length that is greater than the distance between the first sound outlet and the second sound outlet. The sound conditioner is slidably positioned in the sliding groove so as to allow the sound produced by the speaker to be transmitted to the outside via either the first sound outlet or the second sound outlet.

In the above-mentioned embodiment, the area of the first sound outlet is the same as the area of the second sound outlet, and the depth of a portion of the sliding groove that corresponds to the first sound outlet is the same as the depth of a portion of the sliding groove that corresponds to the second sound outlet.

In the above-mentioned embodiment, the sound conditioner includes a tube structure, a front opening is formed on an upper side wall of the tube structure and arranged adjacent to the first end portion of the tube structure, and a rear opening is formed at the tube structure and arranged adjacent to the second end portion of the tube structure, the first end being opposite to the second end.

In the above-mentioned embodiment, the area of the front opening is the same as the area of the rear opening.

In the above-mentioned embodiment, the area of the rear opening is the same as the area of the first sound outlet or the area of the second sound outlet.

In the above-mentioned embodiment, the sound conditioner includes a plate extending along the sliding groove.

In the above-mentioned embodiment, when the second outlet is blocked by the sound conditioner, the sound produced by the speaker is directly transmitted to the outside of the electronic device via the first sound outlet.

In the above-mentioned embodiment, when the first outlet is blocked by the sound conditioner, the sound produced by the speaker is transmitted to the outside of the electronic device via the sound guiding passage in the sound conditioner and the second sound outlet.

In the above-mentioned embodiment, the first sound outlet and the speaker are positioned at two sides of the sound conditioner.

In the above-mentioned embodiment, the first sound outlet and the second sound outlet are positioned at the same bottom side wall of the sliding groove.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
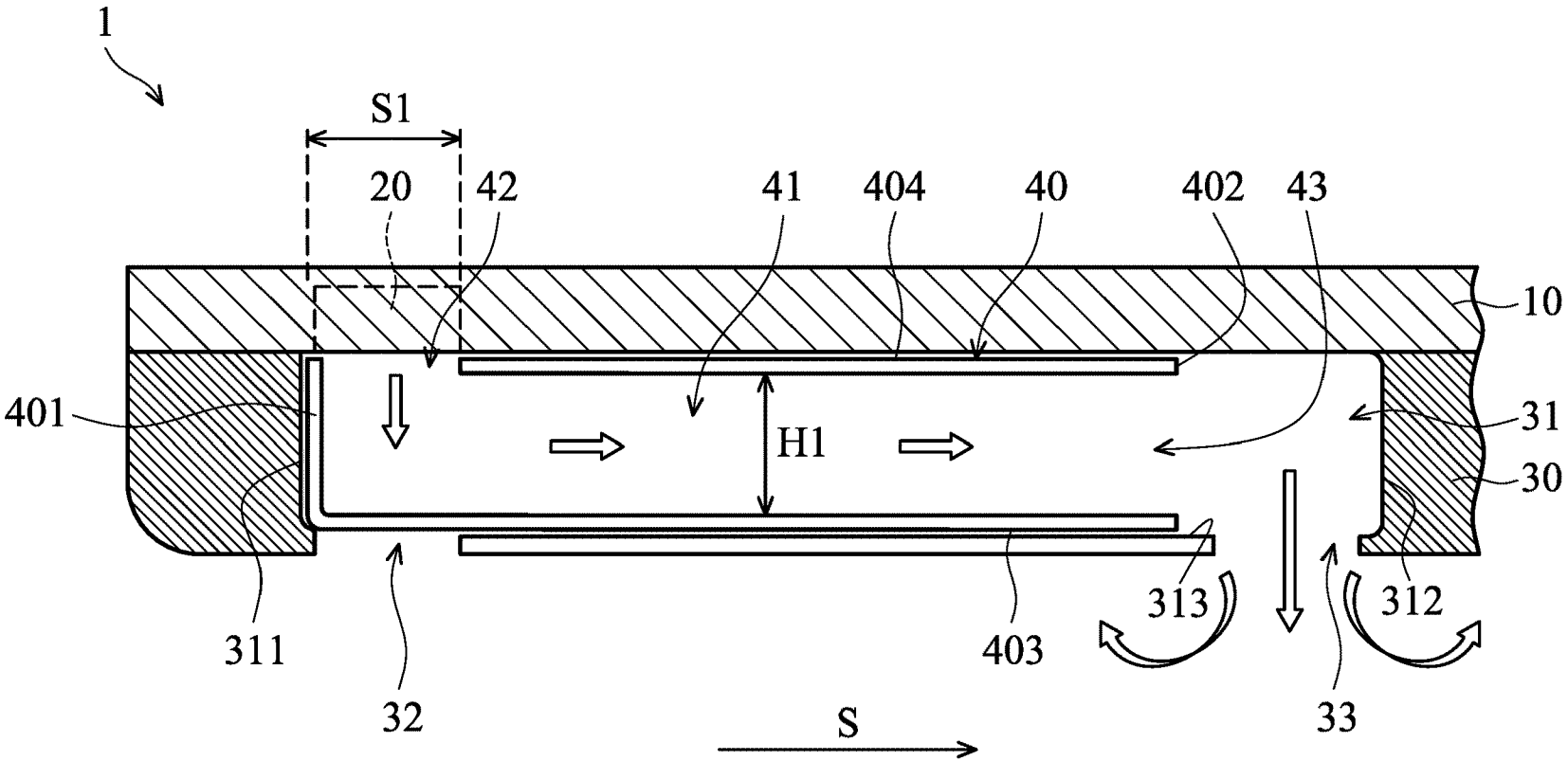
FIG. 1 shows a cross-sectional schematic view of an electronic device having a sound conditioner in a first position, in accordance with some embodiments of the disclosure.

In the following detailed description, for purposes of explanation, numerous specific details and embodiments are set forth in order to provide a thorough understanding of the present disclosure. The specific elements and configurations described in the following detailed description are set forth in order to clearly describe the present disclosure. It will be apparent, however, that the exemplary embodiments set forth herein are used merely for the purpose of illustration, and the inventive concept may be embodied in various forms without being limited to those exemplary embodiments. In addition, the drawings of different embodiments may use like and/or corresponding numerals to denote like and/or corresponding elements in order to clearly describe the present disclosure. However, the use of like and/or corresponding numerals in the drawings of different embodiments does not suggest any correlation between different embodiments.

It should be noted that the elements or devices in the drawings of the present disclosure may be present in any form or configuration known to those skilled in the art. In addition, the expression "a layer overlying another layer", "a layer is disposed above another layer", "a layer is disposed on another layer" and "a layer is disposed over another layer" may indicate not only that the layer directly contacts the other layer, but also that the layer does not directly contact the other layer, there being one or more intermediate layers disposed between the layer and the other layer.

In this specification, relative expressions are used. For example, "lower", "bottom", "higher" or "top" are used to describe the position of one element relative to another. It should be appreciated that if a device is flipped upside down, an element at a "lower" side will become an element at a "higher" side.

The terms "about" and "substantially" typically mean +/−20% of the stated value, more typically +/−10% of the stated value and even more typically +/−5% of the stated value. The stated value of the present disclosure is an approximate value. When there is no specific description, the stated value includes the meaning of "about" or "substantially".

FIG. 1 shows a cross-sectional schematic view of an electronic device 1, in accordance with a first embodiment of the disclosure. The electronic device 1, for example, is a mobile cell phone, a tablet, or a notebook and includes a first substrate 10, a speaker 20, a second substrate 30, and a sound conditioner 40. The elements of the electronic device 1 can be added to or omitted, and the invention should not be limited by the embodiment.

In some embodiments, the first substrate 10 is a circuit board, and the second substrate 30 is a portion of a housing of the electronic device 1. The second substrate 30 may be made of metal or plastic material. The first substrate 10 and other elements of the electronic device 1 (such as control chip) are positioned in a space defined by the housing. However, the disclosure should not be limited thereto. In some other embodiments, the first substrate 10 is a portion of a housing of the electronic device 1, elements of the electronic device 1, such as circuit board and control chip (not shown in figures), are positioned in a space defined by the housing. The second substrate 30 is a protective cover detachably connected to the first substrate 10. The first substrate 10 and the second substrate 30 may be made of metal or plastic material.

The speaker 20 is configured to receive electric signals and convert the signals to sound. In some embodiments, the speaker 20 is disposed on the first substrate 10. The sound produced by the speaker 20 is transmitted to the outside of the electronic device 1 via sound outlets 32 and 33 on the second substrate 30. The configuration of the sound outlets 32 and 33 are described below.

In some embodiments, the second substrate 30 is arranged to be immediately adjacent to the first substrate 10. A sliding groove 31 is formed on one side of the second substrate 30 that faces the first substrate 10. In some embodiments, the sliding groove 31 extends from the first side wall 311 to the second side wall 312 with unit width and depth (i.e., the sliding groove has unit cross section). A bottom side wall 313 connects the first side wall 311 to the second side wall 312.

At the position near the first side wall 311, the sound outlet 32 is formed on the bottom side wall 313 and connects to the sliding groove 31. In addition, at the position adjacent to the second side wall 312, the sound outlet 33 is formed on the bottom side wall 313 and connects to the sliding groove 31. The sound outlet 32 is spaced from the sound outlet 33 by a distance, not connected to one the other. The distance between the sound outlet 32 and the sound outlet 33 may range from about 1 mm to about 300 mm. For the purpose of illustration, in the following descriptions, the sound outlet 32 is referred to first sound outlet, and the sound outlet 33 is referred to second sound outlet.

Figure 2B:
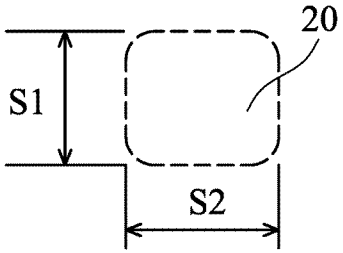
FIG. 2B shows a schematic view of a speaker, in accordance with some embodiment of the disclosure.
Figure 2A:
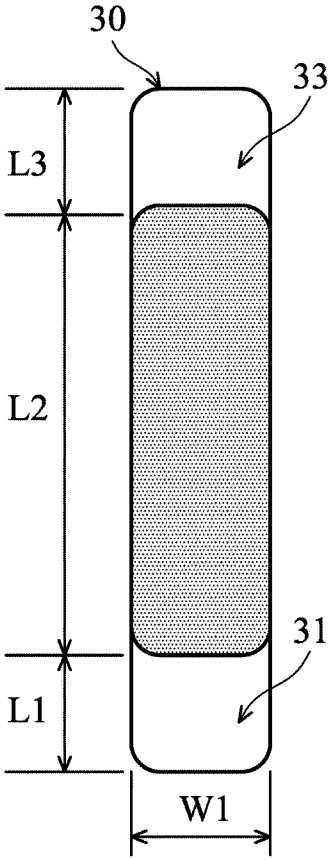
FIG. 2A shows a schematic view of a sliding groove, in accordance with some embodiment of the disclosure.

Referring to FIG. 2A, the first sound outlet 32 has a length of L2 and a width of W1, the area of the first sound outlet 32 is the length L1 times the width W1. Additionally, the second sound outlet 33 has a length of L3 and a width of W1, the area of the second sound outlet 33 is the length L3 times the width W1. In some embodiments, the length L1 equals the length L3, so that the area of the first sound outlet 32 is the same as the second sound outlet 33. In some embodiments, the area of the first sound outlet 32 and the area of the second sound outlet 33 are the same as the area of the speaker 20 (i.e., length S1 times width S2 of the speaker 20, as shown in FIG. 2B). The advantages that result from the above features will be illustrated below.

Referring to FIG. 1, the sound conditioner 40 is slidably disposed in the sliding groove 31 so as to change the sound outlet for transmitting sound from the speaker 20. In some embodiments, the sound conditioner 40 is a tube structure extending form a first end portion 401 to a second end portion 402. The length of the sound conditioner 40 from the first end portion 401 to the second end portion 402 is greater than the distance L2 (FIG. 2A) between the first sound outlet 32 and the second sound outlet 33.

The sound conditioner 40 defines a sound guiding passage 41 therein. In some embodiments, the sound conditioner 40 is a hollow rectangular tube. The cross section of the sound conditioner 40 is the same as the area of the speaker 20 (i.e., length S1 times width S2 of the speaker 20, as shown in FIG. 2B). In some embodiments, the sound conditioner 40 includes a lower side wall 403 and an upper side wall 404. After the sound conditioner 40 is disposed in the sliding groove 31, the lower side wall 403 is in contact with the bottom side wall 313, and the upper side wall 404 is aligned with the sliding groove 31.

A front opening 42 is formed at the upper side wall 404 of the sound conditioner 40 and arranged adjacent to the first end 401, and a rear opening 43 is formed at the sound conditioner 40 and arranged adjacent to the second end portion 402. Except for the front opening 42 and the rear opening 43, other side wall of the sound conditioner 40 is closed. In some embodiments, after the sound conditioner 40 is positioned in the sliding groove 31, the first end portion 401 of the sound conditioner 40 faces the first side wall 311 of the sliding groove 31, and the second end portion 402 of the sound conditioner 40 faces the second side wall 312 of the sliding groove 31.

In some embodiments, the distance H1 between the upper side wall 404 and lower side wall 403 of the sound conditioner 40 is the same as the height H1 of the speaker 20. Additionally, the area of the front opening 42 of the sound conditioner 40 is the same as the area of the speaker 20. Moreover, the area of the rear opening 43 of the sound conditioner 40 is the same as the area of the speaker 20. As a result, the cross section of the sound guiding passage 41 is the same as the area of the speaker 20. In some embodiments, the inner wall of the sound guiding passage 41 is a smooth surface, low energy loss or very little energy loss occurs during the transmission of the sound in the sound guiding passage 41. With the above-mentioned features, the sonic energy as the sound is entering the sound guiding passage 41 via the front opening 42 is substantially equal to the sonic energy as the sound is leaving the sound guiding passage 41 via the rear opening 43.

The operation method of the electronic device 1, in accordance with some embodiments of the disclosure, is described below.

Referring to FIG. 1, to transmit sound from the speaker 20 via the second sound outlet 33, the sound conditioner 40 is arranged at a first position. At this time, the first sound outlet 32 is blocked by the sound conditioner 40, the sound from the speaker 20 passes through the front opening 42, the sound guiding passage 41, the rear opening 43 and enters a section of the sliding groove 31 corresponding to the second sound outlet 33. As a result, the sound from the speaker 20 is transmitted to the outside of the electronic device 1 via the second sound outlet 33.

Figure 3:
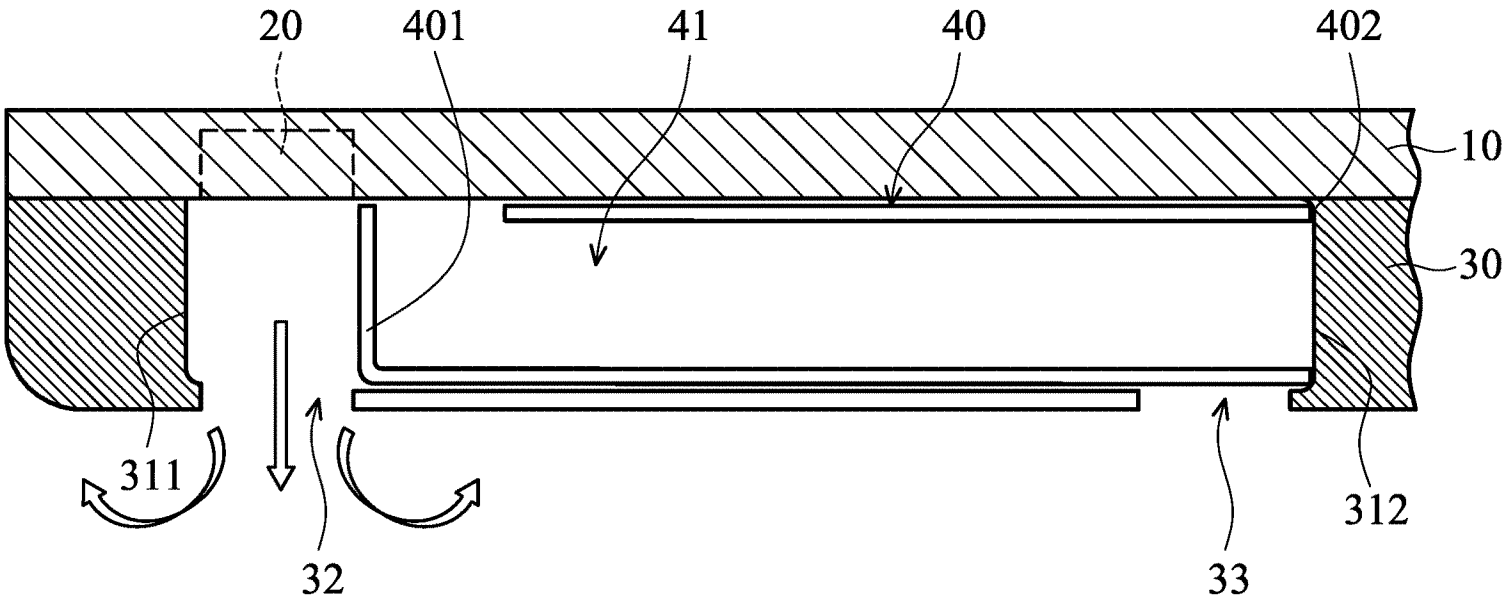
FIG. 3 shows a cross-sectional schematic view of an electronic device having a sound conditioner in a second position, in accordance with some embodiments of the disclosure.

To transmit sound from the speaker 20 via the first sound outlet 32, the sound conditioner 40 is moved along a direction as indicated by the arrow S of FIG. 1 to a second position as shown in FIG. 3. At this time, the second sound outlet 33 is blocked by the sound conditioner 40, the sound from the speaker 20 enters a section of the sliding groove 31 corresponding to the first sound outlet 32. As a result, the sound from the speaker 20 is transmitted to the outside of the electronic device 1 via the first sound outlet 32.

In some embodiments, the position of the sound conditioner 40 is changed manually. Alternatively, the position of the sound conditioner 40 is changed by a built-in driving module (not shown in figures) as a detection member (not shown in figures) detects changes in the orientation of the electronic device 1.

It should be noted that the vacant volume above the second sound outlet 33 in the sliding groove 31 when the sound conditioner 40 is in the first position (FIG. 1) is the same as the vacant volume above the first sound outlet 32 in the sliding groove 31 as the sound conditioner 40 is in the second position (FIG. 3). According to the plane source sound transmitting principle, the sound pressure and the sound intensity of the sound from the two sound outlets 32 and 33 heard by the user are identical. Therefore, the user can select one of the sound outlets that are arranged at two different positions to transmit sound according to demand, so as to have a better listening experience with high sound quality.

Figure 5:
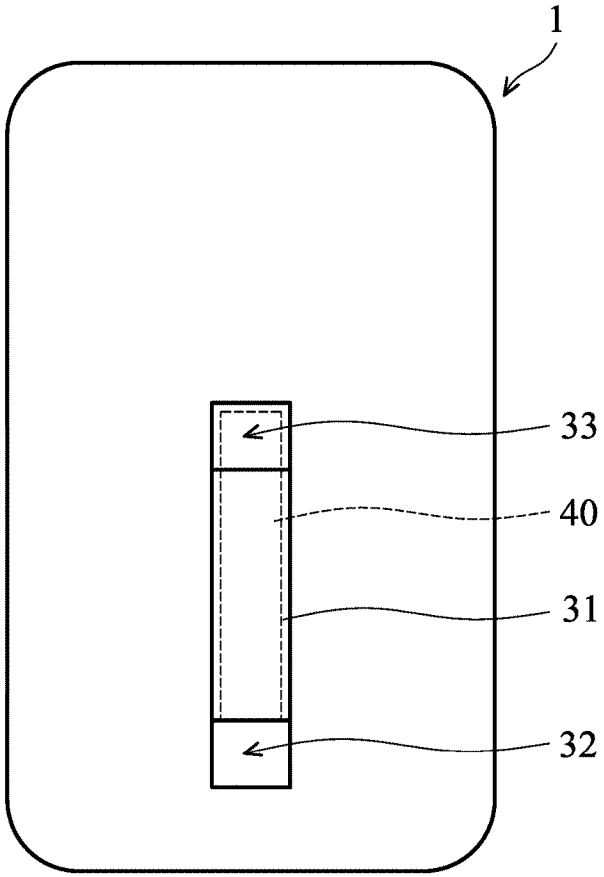
FIG. 5 shows a cross-sectional schematic view of an electronic device having a sound conditioner in a second position, in accordance with some embodiments of the disclosure.
Figure 4:
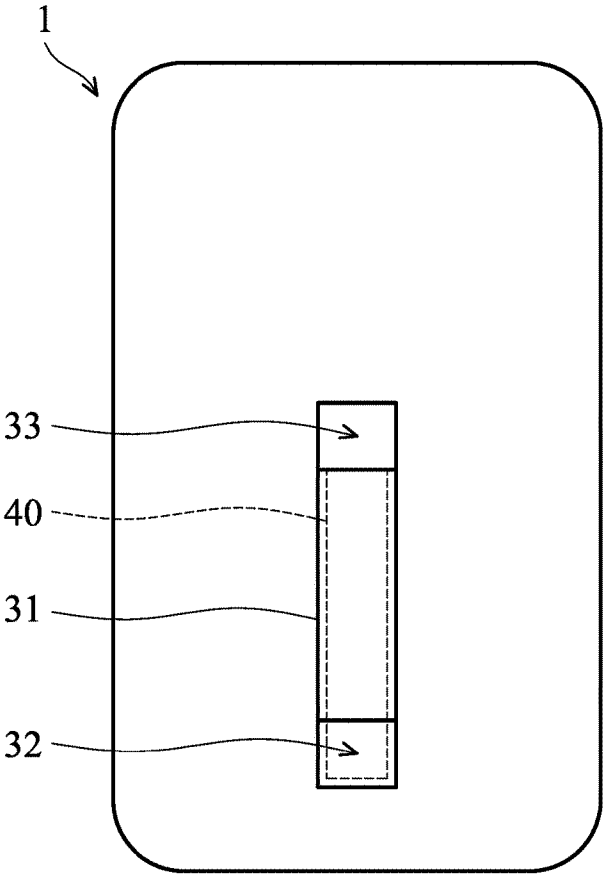
FIG. 4 shows a cross-sectional schematic view of an electronic device having a sound conditioner in a first position, in accordance with some embodiments of the disclosure.

The configuration of the sliding groove 31 can be changed according to design. For example, as shown in FIGS. 4 and 5, the sliding groove 31 extends along the longitudinal axis of the electronic device 1. In addition, the sound conditioner 40 is slidably positioned in the sliding groove 31 along the extension direction thereof to be located in the first position (FIG. 4) and the second position (FIG. 5). When the sound conditioner 40 is in the first position, the sound is transmitted to the outside of the electronic device 1 via the second sound outlet 33 near the center of the electronic device 1. When the sound conditioner 40 is in the second position, the sound is transmitted to the outside of the electronic device 1 via the first sound outlet 32 near the lateral side on the longitudinal axis of the electronic device 1.

Figure 7:
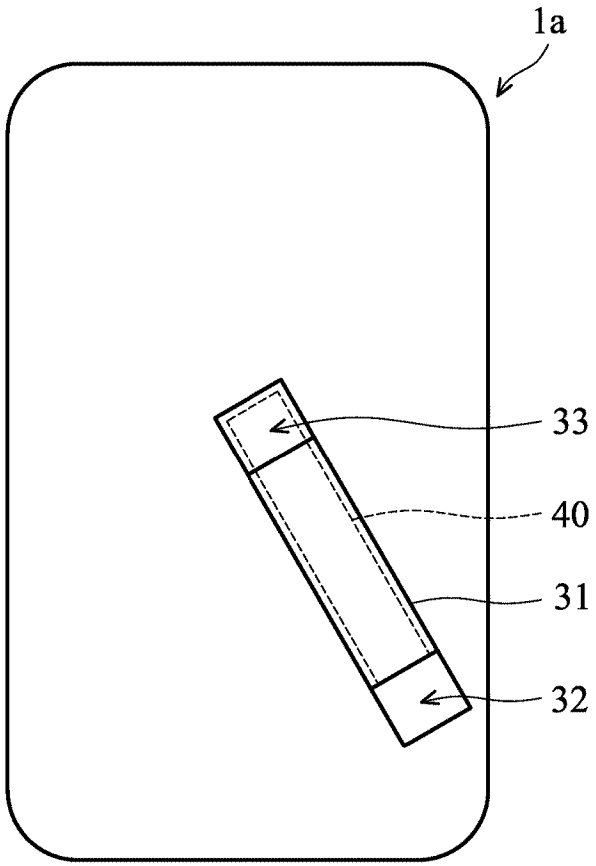
FIG. 7 shows a cross-sectional schematic view of an electronic device having a sound conditioner in a second position, in accordance with some embodiments of the disclosure.
Figure 6:
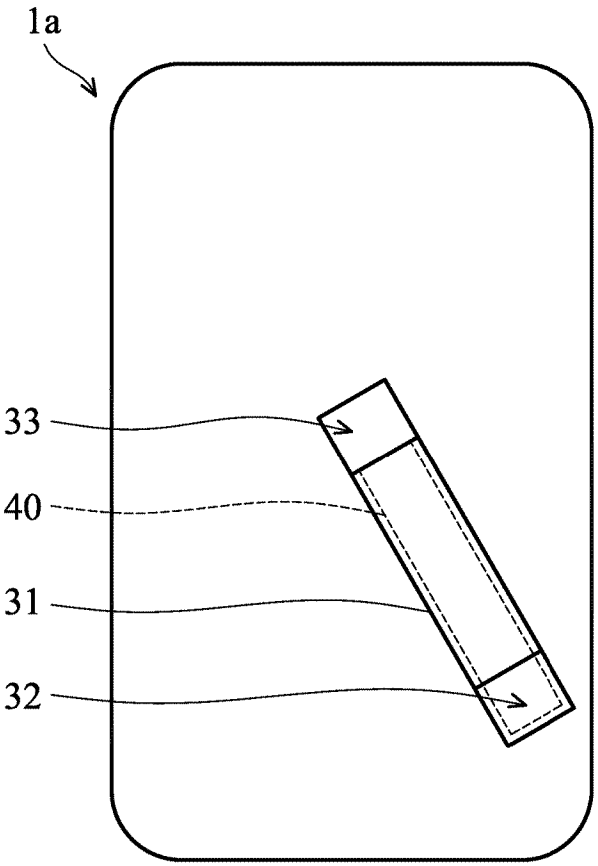
FIG. 6 shows a cross-sectional schematic view of an electronic device having a sound conditioner in a first position, in accordance with some embodiments of the disclosure.

Alternatively, as shown in FIGS. 6 and 7, the sliding groove 31 extends along a direction slanted to the longitudinal axis of the electronic device 1*a*. In addition, the sound conditioner 40 is slidably positioned in the sliding groove 31 along the extension direction thereof to be located in the first position (FIG. 6) and the second position (FIG. 7). When the sound conditioner 40 is in the first position, the sound is transmitted to the outside of the electronic device 1*a* via the second sound outlet 33 near the center of the electronic device 1*a*. When the sound conditioner 40 is in the second position, the sound is transmitted to the outside of the electronic device 1*a* via the first sound outlet 32 near a corner of the electronic device 1*a*.

Figure 9:
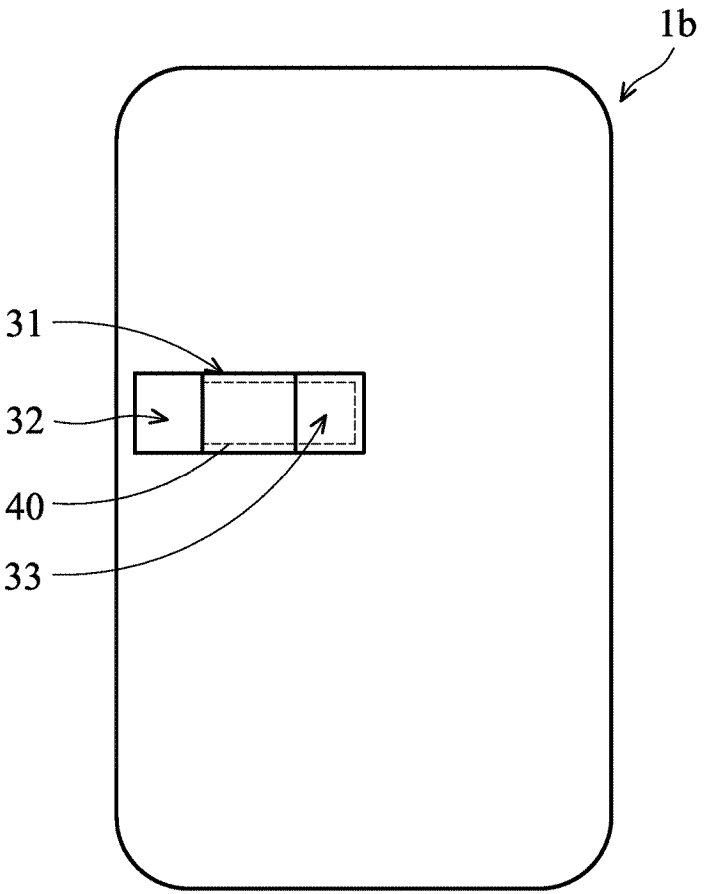
FIG. 9 shows a cross-sectional schematic view of an electronic device having a sound conditioner in a second position, in accordance with some embodiments of the disclosure.
Figure 8:
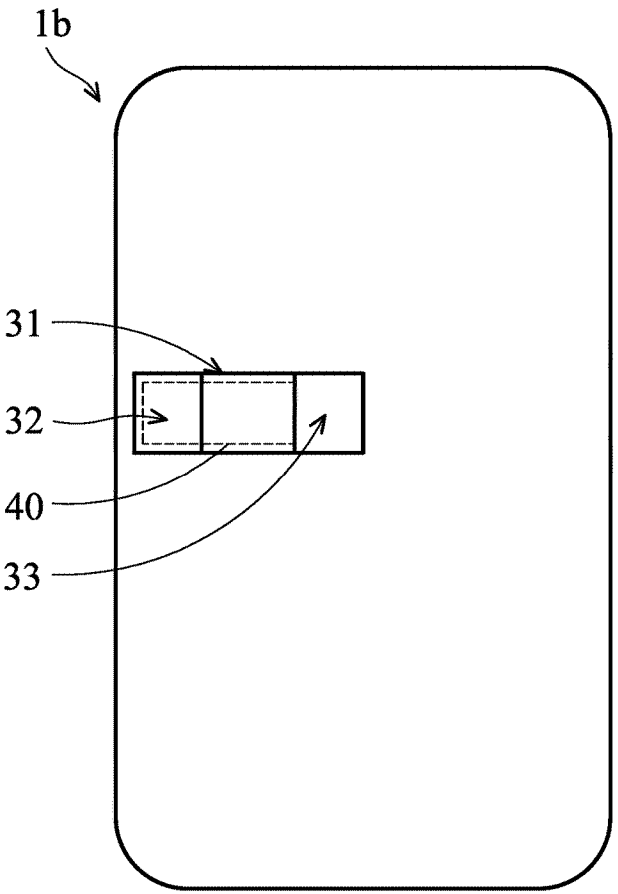
FIG. 8 shows a cross-sectional schematic view of an electronic device having a sound conditioner in a first position, in accordance with some embodiments of the disclosure.

Alternatively, as shown in FIGS. 8 and 9, the sliding groove 31 extends along the short axis of the electronic device 1*b*. In addition, the sound conditioner 40 is slidably positioned in the sliding groove 31 along the extension direction thereof to be located in the first position (FIG. 8) and the second position (FIG. 9). When the sound conditioner 40 is in the first position, the sound is transmitted to the outside of the electronic device 1*b* via the second sound outlet 33 near the center of the electronic device 1*b*. When the sound conditioner 40 is in the second position, the sound is transmitted to the outside of the electronic device 1*b* via the first sound outlet 32 near the lateral side on the short axis of the electronic device 1*b*.

Figure 10:
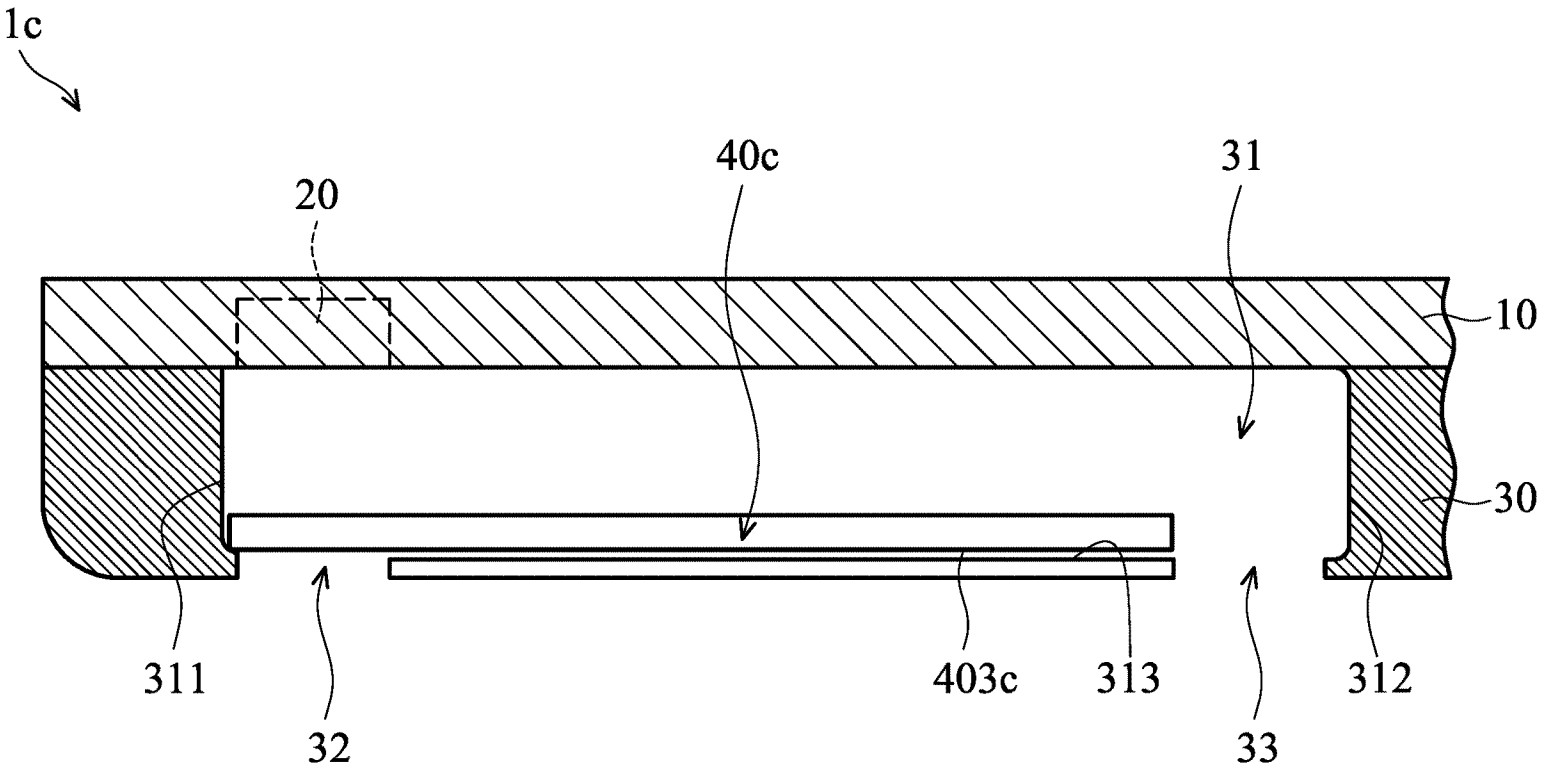
FIG. 10 shows a cross-sectional schematic view of an electronic device having a sound conditioner in a first position, in accordance with some embodiments of the disclosure.

FIG. 10 shows a cross-sectional schematic view of an electronic device 1*c*, in accordance with some embodiments of the disclosure. In the embodiment shown in FIG. 10, elements that are identical with or similar to the elements of the electronic device 1 shown in FIG. 1 are designated by the same reference number, and the features thereof are not repeated for the purpose of brevity. The differences between the electronic device 1 and the electronic device 1*c* include the sound conditioner 40 of the electronic device 1 being replaced by a sound conditioner 40*c*.

In some embodiments, the sound conditioner 40*c* includes a plate structure disposed in the sliding groove 31, wherein the lower side wall of the sound conditioner 40*c* is in contact with the bottom side wall of the sliding groove 31. The sound conditioner 40*c* has a width that is the same as the width of the sliding groove 31. In addition, in the extension direction of the sliding groove, the length of the sound conditioner 40*c* is greater than the distance between the first sound outlet 32 and the second sound outlet 33.

As shown in FIG. 10, when the sound conditioner 40*c* is in the first position, sound is transmitted to the outside of the electronic device 1*c* via the second sound outlet 33. When the sound conditioner 40*c* is in the second position, sound is transmitted to the outside of the electronic device 1*c* via the first sound outlet 32.

The electronic device of the disclosure includes a movable sound conditioner. By changing the position of the sound conditioner, the user can select one of the sound outlets to transmit sound without degradation on sound quality, so as to have a better listening experience.

Although the embodiments and their advantages have been described in detail, it should be understood that various changes, substitutions, and alterations can be made herein without departing from the spirit and scope of the embodiments as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. An electronic device, comprising:

a first substrate;

a second substrate connected to the first substrate and having a first side wall and a second side wall;

a sliding groove formed in the second substrate and extending from the first side wall to the second side wall, wherein a first sound outlet and a second sound outlet are connected to the sliding groove and respectively positioned adjacent to the first side wall and the second side wall;

a speaker positioned relative to the first sound outlet; and a sound conditioner slidably positioned in the sliding groove so as to cover one of the first sound outlet and the second sound outlet to block the sound produced by the speaker from being transmitted to the outside via the covered first sound outlet or the second sound outlet.

2. The electronic device as claimed in claim 1, wherein the area of the first sound outlet is the same as the area of the second sound outlet, and the depth of a portion of the sliding groove that corresponds to the first sound outlet is the same as the depth of a portion of the sliding groove that corresponds to the second sound outlet.

3. The electronic device as claimed in claim 1, wherein the sound conditioner comprises a tube structure, a front opening is formed on an upper side wall of the tube structure and arranged adjacent to the first end portion of the tube structure, and a rear opening is formed at the tube structure and arranged adjacent to the second end portion of the tube structure, the first end being opposite to the second end.

4. The electronic device as claimed in claim 3, wherein the area of the front opening is the same as the area of the rear opening.

5. The electronic device as claimed in claim 3, wherein the area of the rear opening is the same as the area of the first sound outlet or the area of the second sound outlet.

6. The electronic device as claimed in claim 1, wherein the sound conditioner comprises a plate extending along the sliding groove.

7. The electronic device as claimed in claim 1, wherein when the second outlet is blocked by the sound conditioner, the sound produced by the speaker is directly transmitted to the outside of the electronic device via the first sound outlet.

8. The electronic device as claimed in claim 1, wherein when the first outlet is blocked by the sound conditioner, the sound produced by the speaker is transmitted to the outside of the electronic device via the sound guiding passage in the sound conditioner and the second sound outlet.

9. The electronic device as claimed in claim 1, wherein the first sound outlet and the speaker are positioned at two sides of the sound conditioner.

10. The electronic device as claimed in claim 1, wherein the first sound outlet and the second sound outlet are positioned at the same bottom side wall of the sliding groove.

11. The electronic device as claimed in claim 1, wherein the sliding groove extending from the first side wall to the second side wall along a predetermined direction;

wherein the sound conditioner is slidable along the predetermined direction.

12. The electronic device as claimed in claim 11, wherein the sound conditioner abuts against a bottom side wall of the sliding groove that connects the first sound outlet and the second sound outlet.

13. The electronic device as claimed in claim 1, wherein the sound conditioner extends along the sliding groove for a length that is greater than a distance between the first sound outlet and the second sound outlet.

* * * * *